US005261379A

United States Patent [19]

Lipinski et al.

[11] Patent Number: 5,261,379

[45] Date of Patent: Nov. 16, 1993

[54] EVAPORATIVE PURGE MONITORING STRATEGY AND SYSTEM

[75] Inventors: Daniel J. Lipinski, Livonia; Charles E. Marshall, Novi; Ernest C. Prior, Woodhaven, all of Mich.

[73] Assignee: Ford Motor Company, Dearborn, Mich.

[21] Appl. No.: 772,304

[22] Filed: Oct. 7, 1991

[51] Int. Cl.[5] ..... F02M 33/02

[52] U.S. Cl. ..... 123/520; 123/198 D

[58] Field of Search ..... 123/520, 518, 519, 198 D

[56] References Cited

U.S. PATENT DOCUMENTS

| | | | |
|---|---|---|---|
| 4,173,207 | 11/1979 | Hiramatsu | 123/519 |
| 4,664,087 | 5/1987 | Hamburg . | |
| 4,677,956 | 7/1987 | Hamburg . | |
| 4,715,340 | 12/1987 | Cook et al. . | |
| 4,862,856 | 9/1989 | Yokoe et al. | 123/520 |
| 4,867,126 | 9/1989 | Yonekawa | 123/198 D |
| 4,887,578 | 12/1989 | Woodcock et al. | 123/520 |
| 4,949,695 | 8/1990 | Uranishi et al. | 123/520 |
| 4,962,744 | 10/1990 | Uranishi et al. | 123/198 D |
| 5,085,194 | 2/1992 | Kuroda et al. | 123/198 D |
| 5,085,197 | 2/1992 | Mader et al. | 123/518 |
| 5,105,789 | 4/1992 | Aramaki et al. | 123/520 |
| 5,111,796 | 5/1992 | Ogita | 123/520 |
| 5,125,385 | 6/1992 | Frinzel | 123/520 |
| 5,143,035 | 9/1992 | Kayanuma | 123/198 D |
| 5,146,902 | 9/1992 | Cook et al. | 123/519 |
| 5,158,054 | 10/1992 | Otsuka | 123/520 |
| 5,186,153 | 2/1993 | Steinbrenner et al. | 123/520 |
| 5,191,870 | 3/1993 | Cook | 123/520 |

FOREIGN PATENT DOCUMENTS

| | | | |
|---|---|---|---|
| 60423 | 3/1989 | Japan | 123/519 |

*Primary Examiner*—E. Rollins Cross
*Assistant Examiner*—Thomas Moulis
*Attorney, Agent, or Firm*—Peter Abolins; Roger L. May

[57] ABSTRACT

This invention tests the mechanical integrity of an evaporative purge system and fuel system by applying a vacuum to a fuel tank and measuring the extent to which this vacuum bleeds down over a time period. Included in the test method are the steps of closing the vapor management valve positioned between the engine manifold and the evaporative purge flow path of the fuel tank; waiting a predetermined period of time; and obtaining an indication of the extent to which pressure is increasing in the fuel tank due to vapor generation.

4 Claims, 5 Drawing Sheets

EVAPORATIVE PURGE MONITORING STRATEGY AND SYSTEM

BACKGROUND OF THE INVENTION

1. Field of the Invention

This invention relates to managing the evaporative purge system for a vehicle having a fuel tank connected to an internal combustion engine.

2. Prior Art

Various techniques for controlling the evaporative purge are known. For example, see U.S. Pat. Nos. 4,664,087, 4,677,956; and 4,715,340.

There is also a desire to control all emissions emanating from vehicles. To this end it is desirable to be able to test the flow path of the gasoline vapors in the vehicle for leaks. These are some of the problems this invention overcomes.

SUMMARY OF THE INVENTION

This invention tests the mechanical integrity of an evaporative purge system by applying a vacuum to a fuel tank and measuring the extent to which this vacuum bleeds down over a time period. That is, this system is an onboard diagnostic system wherein the integrity of the evaporative purge system can be tested by forming a differential pressure check on the system. To this end, the vacuum is applied to the evaporative purge flow path and the fuel tank pressure is monitored by a sensor.

DETAILED DESCRIPTION OF THE INVENTION

Figure 2:
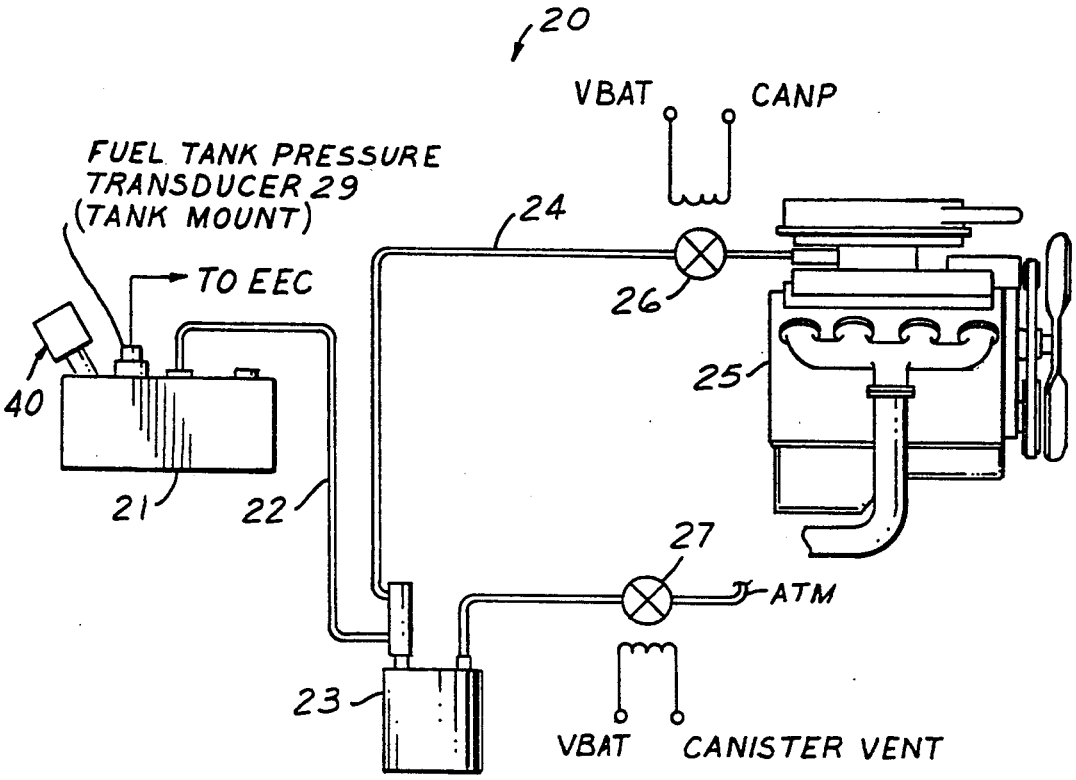
FIG. 2 is a block diagram of the configuration of a canister purge leak detection system in accordance with an embodiment of this invention, wherein a pressure transducer is directly mounted on a fuel tank.
Figure 3:
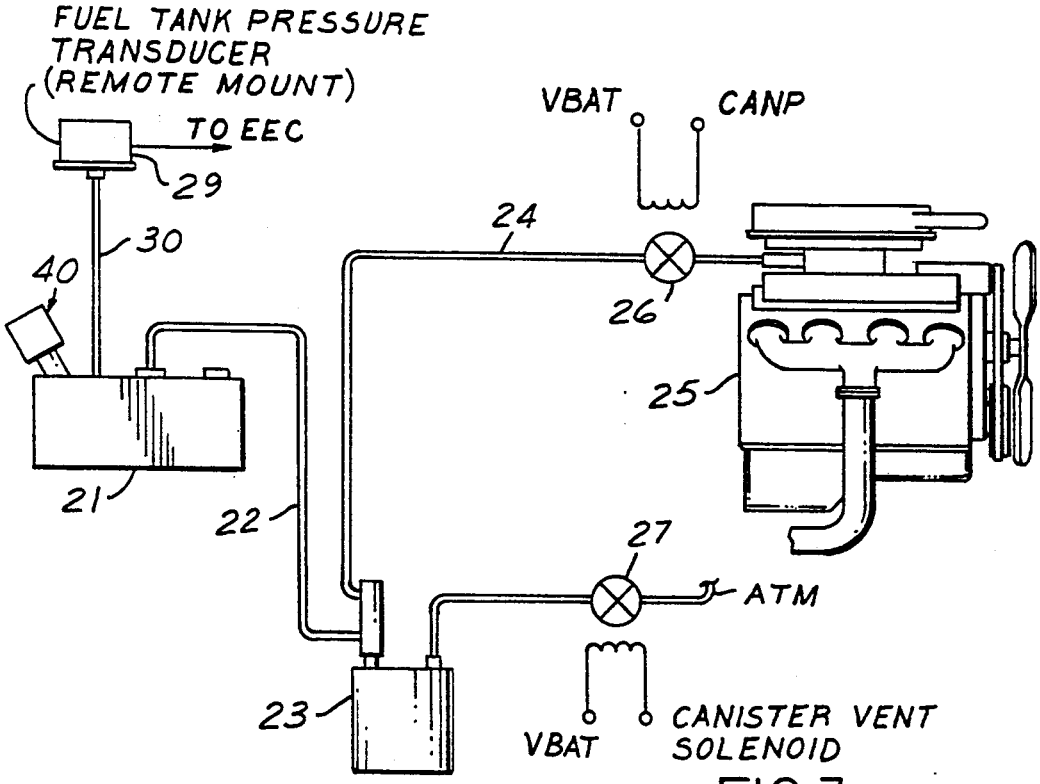
FIG. 3 is a block diagram of the configuration of a canister purge leak detection system in accordance with another embodiment of this invention, wherein a pressure transducer is mounted remotely from a fuel tank.

Referring to FIGS. 2 and 3, a canister purge leak detection system 20 includes a fuel tank 21 which is connected to an evaporative purge line 22 coupled to a charcoal canister 23 and in turn coupled to an evaporative purge line 24 connected to an engine 25 through a valve 26. Canister 23 also is connected to atmosphere through a valve 27. FIG. 2 illustrates a system where a pressure sensor 29 is installed directly into the fuel tank 21. FIG. 3 illustrates an alternative system where a pressure sensor 29 is remotely mounted and connected by a line 30 to the fuel tank 21.

A fuel tank vacuum indicator or a pressure transducer 29 monitors fuel tank pressure or vacuum and provides an input to an electronic engine control. Fuel tank 21 is fashioned to accommodate fuel tank pressure transducer 29. Advantageously there is a flat depression and hole in the top of the tank for receiving the fuel tank pressure transducer subassembly. The evaporative canister vent vacuum solenoid has a solenoid required to close the evaporative canister atmospheric vent during a leak down rate test. The solenoid is controlled by the electric engine control as an output from the controller. The canister vent solenoid is normally opened and high flowing when opened and has very low leakage when closed. A vacuum relief valve 40, integral with the fuel tank cap, prevents excessive vacuum from being applied to the fuel tank system. It is not controlled by an electric engine controller. Typically the vacuum leak valve is integrated into the fuel tank re-fill cap. Vapor management valve 26 and engine purge strategy compensates for additional vapor injected into the engine as a result of performing the vacuum leak down rate test.

A vacuum leak down test of the canister purge system identifies any leak in the fuel/canister purge system that would cause fuel vapor to escape to atmosphere. The test is run by closing valve 27 providing the atmospheric vent for canister 23, then applying a vacuum to the fuel system and observing if the vacuum is held. The test passes if the system can successfully hold the applied vacuum for a predetermined period of time.

The test will begin if all of the following entry conditions are met: 1) the test has not yet been run this trip; 2) powertrain load is within a calibrated window; 3) air charge temperature and engine coolant temperature are below a calibrated maximum value; 4) fuel tank pressure before testing is within a calibrated window; 5) time since the beginning of closed loop air/fuel control operation is greater than a calibrated minimum value; 6) vehicle speed before testing is within a calibrated window.

If desired, an electronic engine control can monitor fuel tank pressure sensor to determine pressure or vacuum conditions during engine operation. Additionally, referring to FIG. 3 a vacuum relief valve 40 can be used to prevent excessive vacuum on the tank.

There are four test phases in addition to a pre-test phase. The pre-test phase is simply the time between engine start-up and the time when the purge system test is begun, but prior to the first purge sequence and prior to enabling adaptive fuel control. The first phase is a pressure build phase. In this portion of the test, the system is sealed by closing both the Vapor Management Valve and the Canister Vent Valve. The pressure is monitored and the increase in tank pressure is calculated over a period of time. This part of the test will indicate the extent to which pressure is increasing in the tank due to vapor generation. If the increase in pressure is above a calibrated maximum value, the test will not be conducted since the "bleed" rate will be skewed by vapor generation. If the pressure increase is below the calibrated maximum value, phase 2 of the test is entered.

Figure 1A:
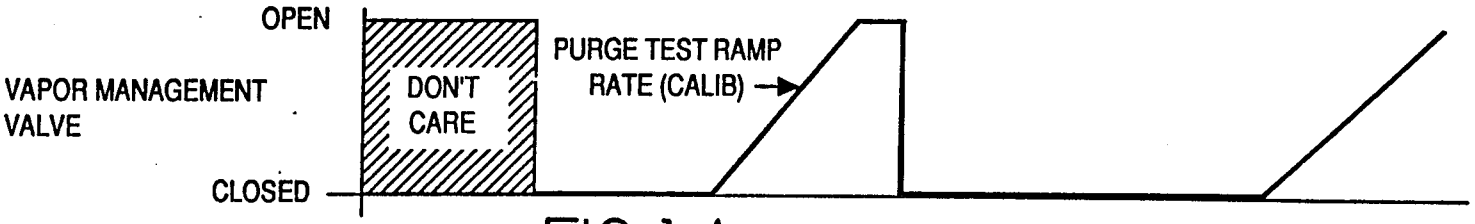
FIG. 1 is a graphical representation of three functions, FIG. 1A being the vapor management valve state with respect to time, FIG. 1B being the canister vent valve state with respect to time and FIG. 1C being the tank pressure with respect to time.
Figure 1B:
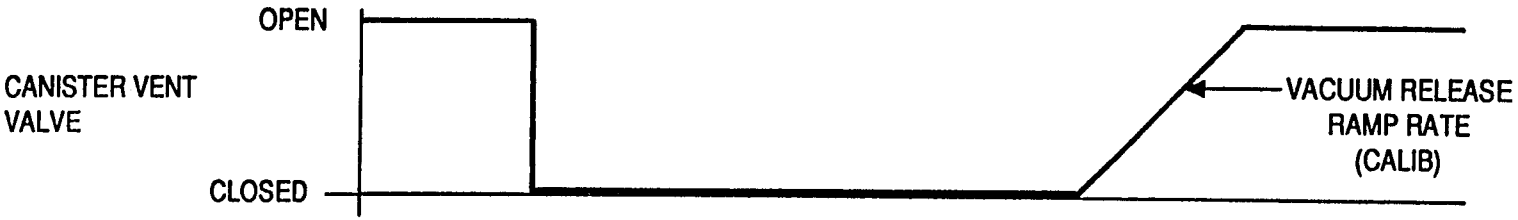
Figure 1C:
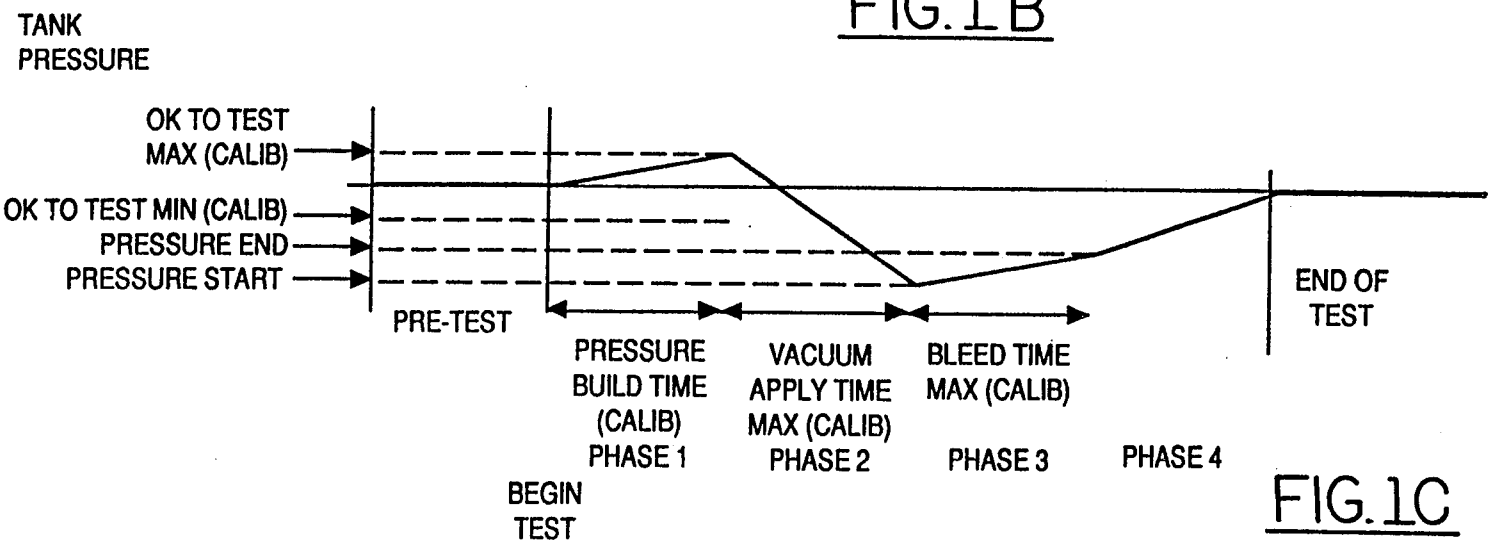

In operation, referring to FIG. 1, vapor management valve 26 and canister vent valve 27 are closed, sealing the fuel system from the atmosphere. Any pressure in fuel tank 21 is monitored by the fuel tank pressure transducer 29 to track pressure increases due to vapor generation. The test is discontinued if the pressure increase is too high for reliable results.

The second phase is a fuel system vacuum application phase. An attempt is made to apply a vacuum of a calibrated value to the fuel system. Vapor management valve 26 is opened to apply engine vacuum to the fuel system. At this time, a canister vent valve 27 remains closed and continues to isolate canister 23 from the atmosphere. As valve 26 is opened, the engine will see vapor that is very rich with fuel vapor. For this reason, an engine control strategy for compensating for the fuel rich vapor must be enabled to allow the engine to consume the vapor. If the target vacuum is not reached in a calibrated amount of time, it must be assumed that this is the result of a fuel system leak so the test fails and an error code is stored. If desired, a malfunction light can be illuminated for the driver to see. If the target vacuum is reached, valve 26 is closed and phase 3 is entered.

Phase three is the vacuum hold phase. This phase tests the capability of the fuel and evaporative purge system to hold a vacuum. Both vapor management valve 26 and canister vent valve 27 are held closed in order to hold the vacuum for a calibrated period of time. At the end of the time period, the change in fuel tank pressure is calculated and this value is compared to a calculated maximum acceptable pressure change. This maximum acceptable pressure change is calculated as a calibrated base value, mathematically modified to compensate for the pressure rise seen during Phase 1. The test passes if the pressure change is below the maximum allowable value and fails if it is above the maximum.

Thus, fuel system vacuum retention capability is checked. Fuel tank 21 vacuum can be monitored by fuel tank pressure transducer 29 to track any reduction or "bleed up" of vacuum. If, after a predetermined time period, the vacuum in fuel tank 21 is held to a acceptable predetermined amount, the test is considered to have been passed. On the other hand, if fuel tank 21 is unable to retain a vacuum, a fault is recorded in an electronic engine control memory and, if desired, a malfunction light can be illuminated.

Phase four is the end of test. This final phase of the test returns the purge system to normal engine purge. The canister vent solenoid opens valve 27 at a calibrated ramp rate to the full open position. The engine control system is allowed to return to either purge or adaptive fuel learning, whichever the engine strategy is requesting at the present time.

The test includes early exit conditions when no error code is stored. Over the duration of the test, several occurrences are possible that may require the early termination of the test. These occurrences are those that would, in high probability, result in a false error code, such as, operation out of a load window or vehicle speed window. The test will be aborted if the vehicle is taken out of the calibrated load window after the test is begun.

Figure 4A:
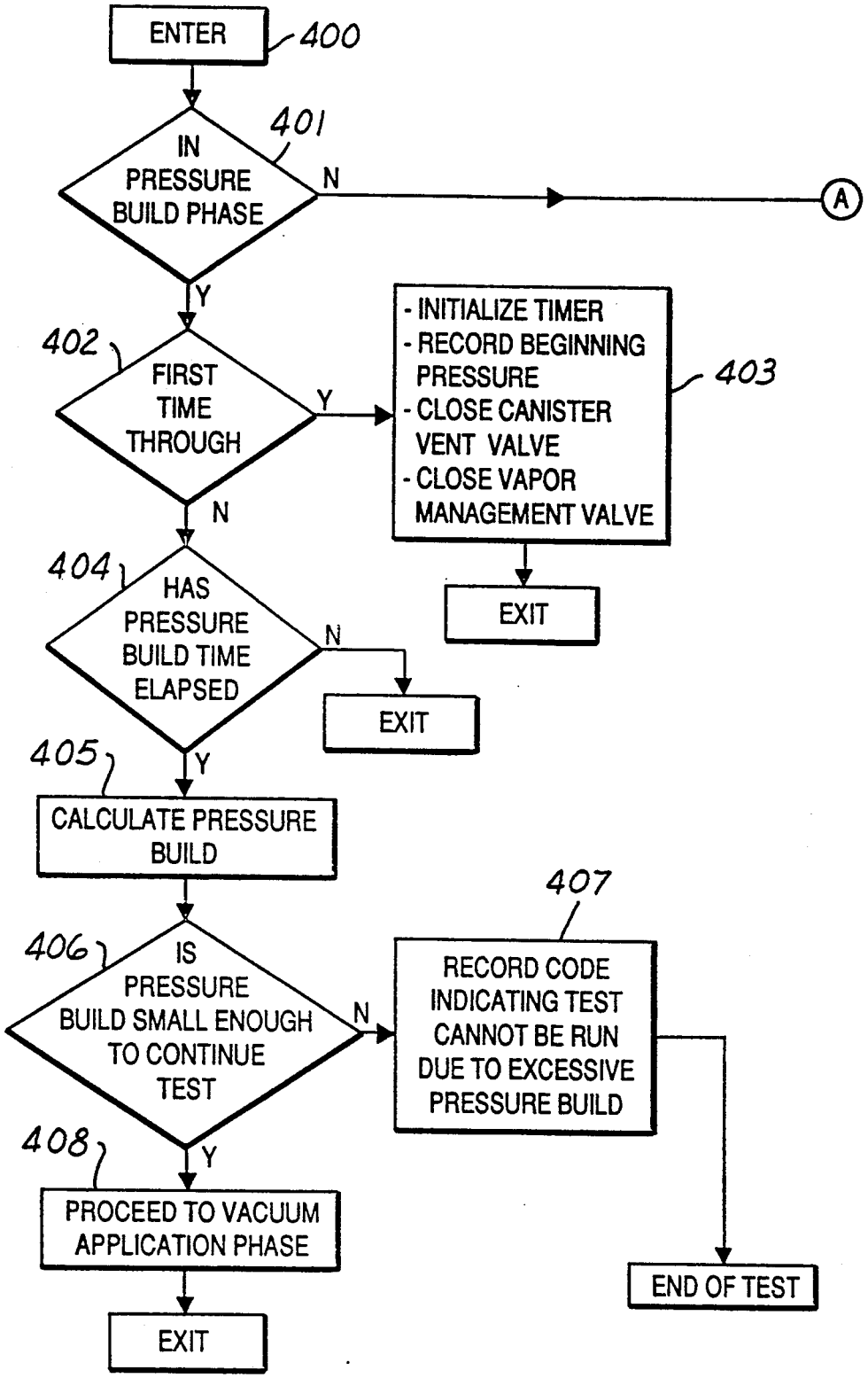
FIGS. 4A, 4B and 4C are logical flow diagrams of a test in accordance with an embodiment of this invention.
Figure 4B:
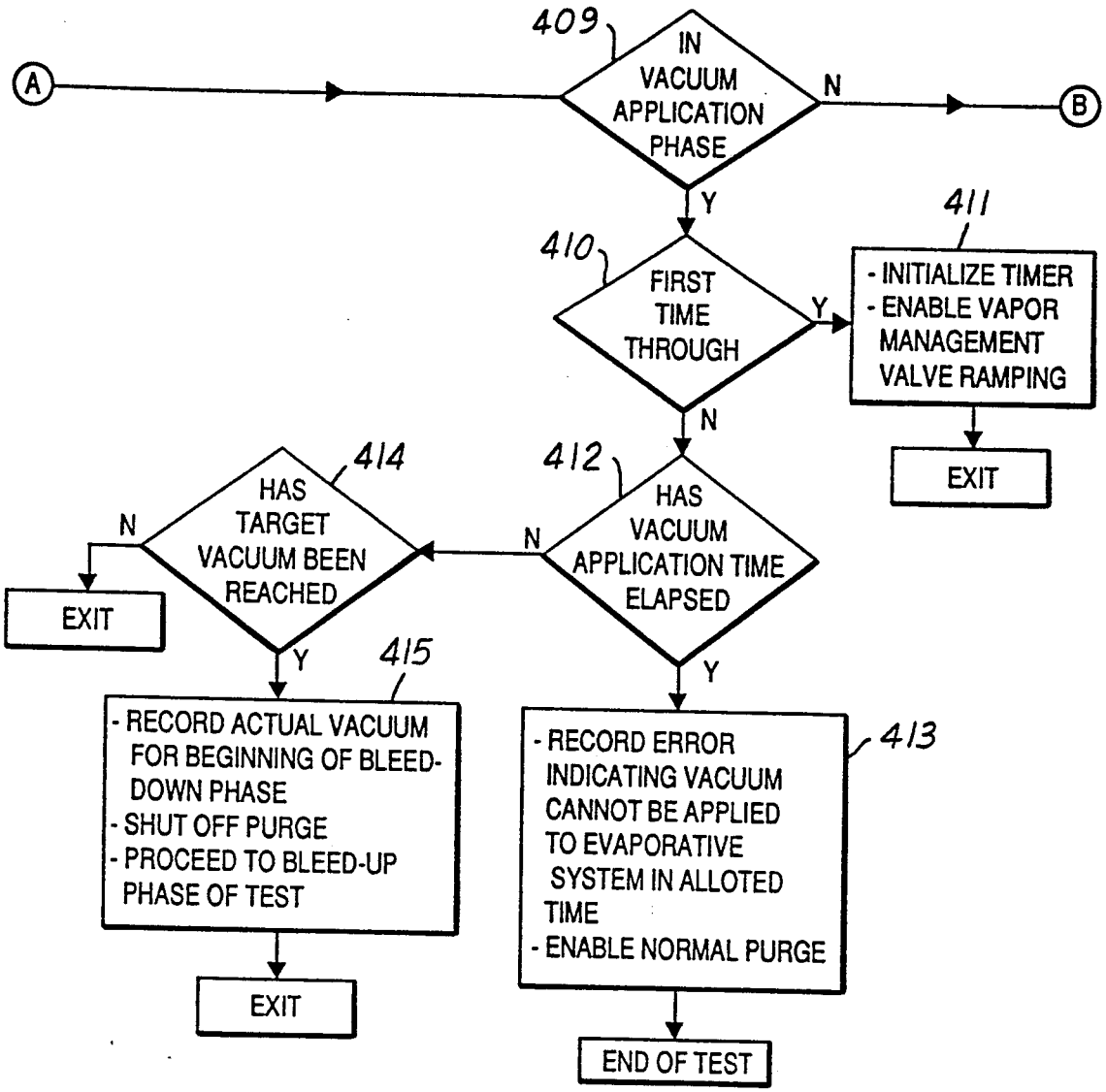
Figure 4C:
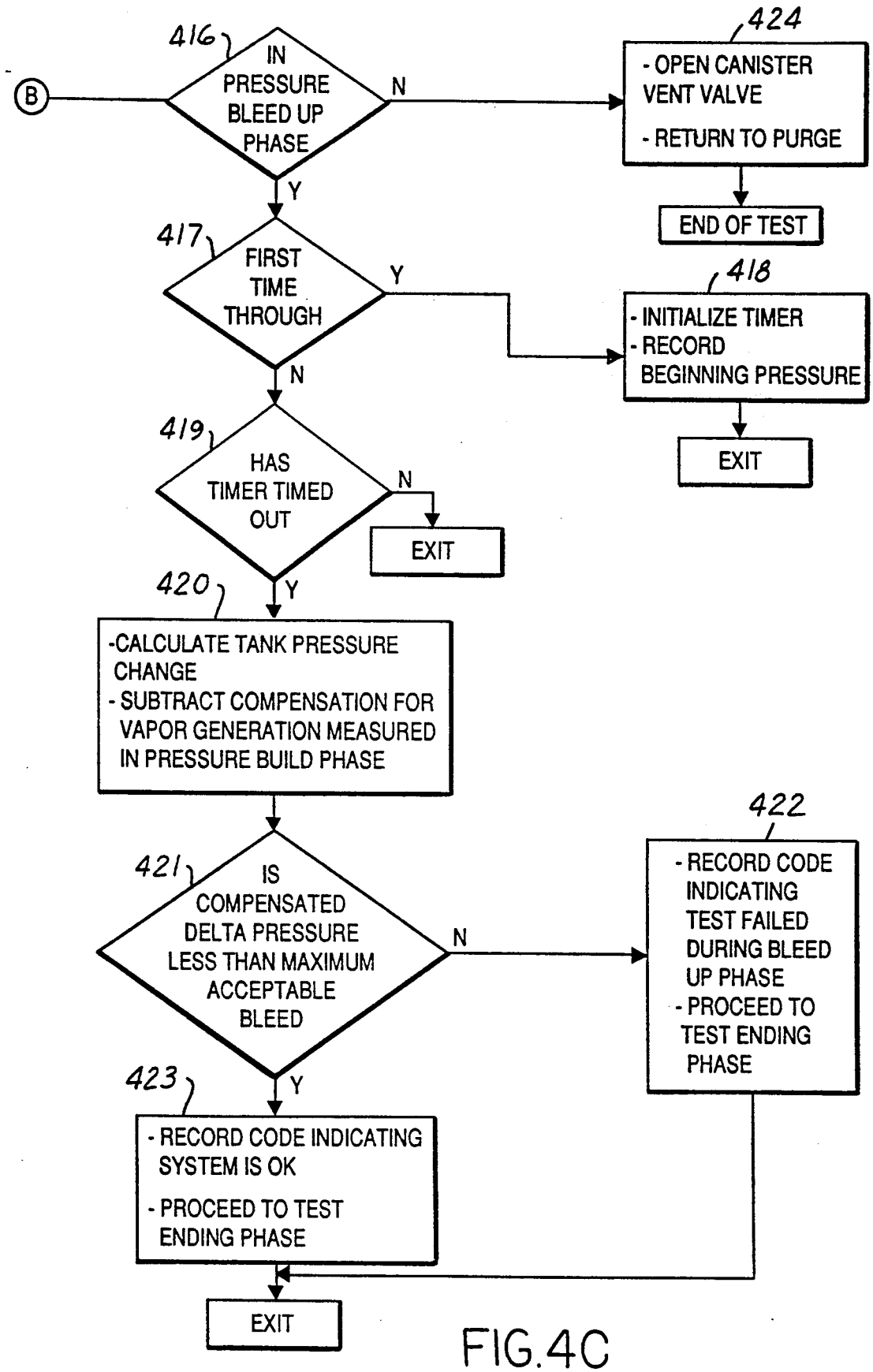

Referring to FIGS. 4A, 4B and 4C, an evaporative purge monitor strategy flow chart begins at an enter block 400. Logic flow then goes to a decision block 401 where it is questioned if the system is in the pressure build phase. If the answer is yes, logic flow goes to a decision block 402 wherein it is asked if this is the first time through. If the answer is yes, logic flow goes to a block 403 wherein a timer is initialized, the beginning pressure is reported, and the canister vent solenoid and canister vent valve are closed. If the answer in decision block 402 is no, logic flow goes to a decision block 404 wherein it is asked if the pressure build time has elapsed. If the answer is no, logic flow goes to an exit. If the answer is yes, logic flow goes to a block 405 wherein the pressure build is calculated. Logic flow then goes to a decision block 406 wherein it is asked if the pressure build is small enough to continue the test. If the answer is no, logic flow goes to a block 407 wherein there is recorded a code indicating a test cannot be run due to excessive pressure build. Logic flow from block 407 goes to an end of test. If the answer at decision block 406 is yes, logic flow goes to a block 408 wherein logic proceeds to a vacuum application phase of the test. Logic flow from block 408 goes to an exit.

If the answer at decision block 401 is no indicating that the system is not in a pressure build phase, logic flow goes to a decision block 409 wherein it is asked if the system is in a vacuum application phase. If the answer is yes, logic flow goes to a block 410 where it is asked if it is the first time through. If the answer is yes, logic flow goes to a block 411 wherein the time is initialized and the vapor management valve ramping is enabled. Logic flow then goes to an exit. If the answer at decision block 410 is no indicating that this is not the first time through, logic flow goes to a decision block 412 where it is asked has the vacuum application time elapsed. If the answer is yes, logic flow goes to a block 413 wherein the error indicating vacuum cannot be applied to the evaporative system in the allotted time is recorded and normal purge is enabled. Logic flow then goes to an end of test. If at decision block 412 the answer is no indicating that vacuum application time has not elapsed, logic flow goes to a decision block 414 wherein it is asked if the target vacuum has been reached. If the answer is no, logic flow goes to an exit. If the answer is yes, logic flow goes to block 415 wherein the actual vacuum for beginning of the bleed up phase is recorded, the vapor management valve is closed, disabling purge for the remainder of the test, and the vacuum bleed up phase of the test is begun. Logic flow then exists.

If at decision block 409 the answer is no indicating that the system is not in the vacuum application phase, logic flow goes to a block 416 where it is asked if the system is in the pressure bleed up phase. If the answer is yes, logic flow goes to a decision block 417 where it is asked if this is the first time through. If the answer is yes, logic flow goes to a block 418 wherein the timer is initialized, fuel tank pressure is recorded, and then to an exit. If the answer is no, logic flow goes to a decision 419 where it is asked if the time has timed out. If the answer is no, logic flow goes to an exit. If the answer is yes at block 419, logic flow goes to a block 420 wherein the tank pressure change is calculated, the compensation for vapor generation measured in pressure build up phase is subtracted. Logic flow then goes to a decision block 421 where it is asked, is the compensated delta pressure less than the maximum acceptable bleed. If the answer is no, logic flow goes to a block 422 wherein there is recorded the code indicating a test failed during the bleed up phase, and logic proceeds to a test ending phase. If the answer at decision block 421 is yes indicating that the compensated delta pressure is less than the maximum acceptable bleed, logic flow goes to a block 423 wherein a code indicating system as ok is recorded and logic proceeds to a test ending phase. Logic flow goes to an exit from block 423 and similarly, from block 422.

If at decision block 416 the answer is no indicating that the system was not in the pressure bleed up phase, logic flow goes to a block 424 which opens the canister vent valve and then subsequently logic flow goes to an end of test.

Logic flow into enter block 400 is done approximately at 40 millisecond intervals until the entire purge monitor test is complete. When the purge monitor test routine reaches an exit point, the test is in progress and will reenter after approximately 40 milliseconds at block 400. When the evaporative purge monitor routine reaches an end of test point, the test is complete and the routine will not be executed again during the current vehicle trip.

If desired, there can be a tank pressure (TPR) sensor input and self test. This module reads and converts the tank pressure sensor input. The A/D is read and the raw counts (TPR_CNTS) are converted into engineering units (TPR_ENG). TPR_ENG is the value used when performing any input testing. And, it is this value that will be later used for service diagnostics. Next, the TPR_ENG value is tested for "out of range" or other failure conditions. If a failure is present for a sufficient amount of time, the appropriate malfunction flag (PxxxMALF) is set. Finally, a timer is checked to see if the component has been sufficiently monitored for this trip.

Various modifications and variations will no doubt occur to those skilled in the art to which this invention pertains. For example, the means for applying the vacuum may be varied from that disclosed herein. This and all other variations which basically rely on the teachings through which this disclosure has advanced the art are properly considered within the scope of this invention.

What is claimed:

1. A method of monitoring an evaporative purge flow path of a fuel system for a vehicle including sealing the evaporative flow path with respect to the atmosphere by the step of:

closing a vapor management valve positioned between an engine manifold vacuum and an evaporative purge flow path of a fuel tank;

waiting a predetermined period of time;

obtaining an indication of the extent to which pressure is increasing in the fuel tank due to vapor generation;

stopping further testing if the increase in pressure is above a predetermined maximum pressure value;

continuing with the test if the pressure increase is below the predetermined maximum pressure value, so that any pressure change by vapor generation is within an acceptable amount;

applying a vacuum to the evaporative purge flow path;

isolating the evaporative purge flow path from the atmosphere and the vacuum source and monitoring any change in vacuum; and returning the evaporative purge flow path to a normal purge operation.

2. A method of monitoring an evaporative purge flow path as recited in claim 1 wherein the step of applying a vacuum includes:

closing a canister vent valve between the atmosphere and a canister and opening the vacuum manifold valve;

adjusting engine operation to accommodate consumption of fuel vapor from the evaporative purge flow path;

waiting a predetermined period of time;

if a predetermined target vacuum is not reached in a calibrated amount of time, stopping further testing and storing an error code indicating test failures; and if a target vacuum is reached within the calibrated amount of time, closing the vacuum manifold valve.

3. A method of monitoring an evaporative purge flow path as recited in claim 1 wherein the steps of applying the vacuum and isolating the evaporative purge flow path include:

closing the vapor management valve and canister vent valve in order to hold the vacuum in the evaporative purge flow path;

waiting a predetermined period of time;

detecting a change in fuel tank vacuum;

comparing the change to a predetermined maximum acceptable pressure change;

passing the test if the pressure change is below the predetermined maximum acceptable pressure change; and failing the test if the pressures change is above the predetermined maximum acceptable pressure change.

4. A method of monitoring an evaporative purge flow path including the steps of:

closing a vapor management valve positioned between an engine manifold vacuum and an evaporative purge flow path of a fuel tank, in order to obtain an indication of the extent to which pressure is increasing in the fuel tank due to vapor generation;

stopping further testing if the increase in pressure is above a calibrated maximum value;

continuing with the test if the pressure increase is below a calibrated maximum value, so that pressure during a vacuum bleed up period is not altered by vapor generation beyond a desired amount;

closing a canister vent valve to the atmosphere and opening the vapor management valve;

adjusting engine operation to accommodate consumption of fuel vapor from the evaporative purge flow path;

stopping further testing if a predetermined target vacuum is not reached within a calibrated amount of time and storing an error code indicating test failures;

if a target vacuum is reached within the calibrated amount of time, closing the vapor management valve;

closing the vapor management valve and the canister vent valve in order to hold the vacuum in the evaporative purge flow path;

waiting a predetermined period of time;

detecting a change in fuel tank vacuum;

comparing the change to a calibrated maximum acceptable pressure change;

passing the test if the pressure change is less than the maximum acceptable change;

failing the test if the pressures change is more than the maximum allowable pressure change; and opening the canister vent valve at a calibrated ramp rate to the open flow position.

* * * * *